US011322815B2

(12) United States Patent
Winslow

(10) Patent No.: US 11,322,815 B2
(45) Date of Patent: May 3, 2022

(54) PREMATCHED POWER RESISTANCE IN LANGE COUPLERS AND OTHER CIRCUITS

(71) Applicant: MACOM Technology Solutions Holdings, Inc., Lowell, MA (US)

(72) Inventor: Thomas Winslow, Salem, VA (US)

(73) Assignee: MACOM TECHNOLOGY SOLUTIONS HOLDINGS, INC., Lowell, MA (US)

( * ) Notice: Subject to any disclaimer, the term of this patent is extended or adjusted under 35 U.S.C. 154(b) by 15 days.

(21) Appl. No.: 16/855,317

(22) Filed: Apr. 22, 2020

(65) Prior Publication Data

US 2021/0336317 A1 Oct. 28, 2021

(51) Int. Cl.
*H01P 1/26* (2006.01)
*H01P 5/12* (2006.01)
*H01P 5/18* (2006.01)

(52) U.S. Cl.
CPC . *H01P 1/26* (2013.01); *H01P 5/18* (2013.01)

(58) Field of Classification Search
CPC ..... H01P 1/26; H01P 3/08; H01P 5/12; H01P 5/18; H01P 5/186
See application file for complete search history.

(56) References Cited

U.S. PATENT DOCUMENTS 4,129,839 A * 12/1978 Galani ..... H01P 5/12 330/124 R
4,835,496 A * 5/1989 Schellenberg ..... H01P 5/12 330/286
4,968,958 A * 11/1990 Hoare ..... H01P 5/12 333/128
5,740,528 A * 4/1998 Drennen ..... H03D 7/1408 333/26
6,608,535 B2 * 8/2003 Sherman ..... H01P 5/16 333/128
6,690,249 B2 * 2/2004 Ishida ..... H01P 5/10 333/128
6,778,037 B1 * 8/2004 Salmela ..... H01P 5/16 333/109
7,671,698 B2 * 3/2010 Dupont ..... H01P 5/186 333/109

OTHER PUBLICATIONS

Merriam-Webster (Year: 2021).*
EMC Technology, Microwave Components Catalog (Year: 2014).*

* cited by examiner

*Primary Examiner* — Dean O Takaoka
(74) *Attorney, Agent, or Firm* — Perilla Knox & Hildebrandt LLP; Jason M. Perilla

(57) ABSTRACT

Disclosed are various embodiments for a pre-matched power resistance system including a pre-matching network for use with a passive electrical device, such as a Lange coupler or a Wilkinson power splitter, where the system provides a predetermined input impedance across a predetermined target bandwidth. The pre-matched power resistance system network further includes an on-chip thin film resistor disposed on a substrate comprising a plurality of coplanar sub-resistors electrically isolated from one another and a manifold portion comprising a plurality of manifold traces in a tiered arrangement terminating in an electrical connection to a respective one of the coplanar sub-resistors.

25 Claims, 11 Drawing Sheets

PREMATCHED POWER RESISTANCE IN LANGE COUPLERS AND OTHER CIRCUITS

BACKGROUND

Various high-frequency electrical circuits include various types of couplers, such as directional couplers and power combiners. Directional couplers include passive devices that couple a predetermined amount of electromagnetic power in a transmission line with a port, thereby injecting another second signal into a network or sampling a signal. Directional couplers are used in many different radio-frequency (RF) applications, such as mobile phone components, power detection and control circuitry, and so forth.

An example directional coupler includes four ports, namely an input port, a through port, a coupled port, and an isolated port. The isolated port is usually terminated with a terminating resistor. A popular type of directional coupler includes the Lange coupler named after its designer, Julius Lange. Specifically, a terminating resistor, which is required to dissipate relatively high power levels, coupled to the isolated port of a Lange coupler tends to be physically large, exhibiting significant parasitic reactances. High power Lange couplers, for example, requires a terminating resistor that must be sufficiently large in dimension (having a large area resistor body), which can cause excessive series and shunt parasitics that significantly mismatch the terminating resistor from the desired 50 Ω.

TECHNICAL FIELD

The present disclosure relates to the field of semiconductor technology and, more specifically, pre-matched power resistance circuits for use with Lange couplers, Wilkinson power splitter, and similar electronics requiring a terminating impedance of a specific value designed for any given bandwidth of operation.

BRIEF SUMMARY OF THE INVENTION

Various embodiments are disclosed for a pre-matched power resistance system for use with a passive electrical device, such as a Lange coupler, a Wilkinson power splitter, or similar device. A system as described herein may include a passive electrical device and a pre-matched power resistance system electrically connected to the passive electrical device. The pre-matched power resistance system may be configured to provide the passive electrical device with a predetermined input impedance across a predetermined target bandwidth. As such, the pre-matched power resistance system may include a pre-matching network portion, a resistor disposed on a substrate comprising a plurality of sub-resistors electrically isolated from one another, and a manifold portion comprising a plurality of manifold traces in a tiered arrangement terminating in an electrical connection to a respective one of the sub-resistors.

In some embodiments, the sub-resistors can be coplanar and adjacent to one another. Further, in some embodiments, the sub-resistors can include on-chip sub-resistors or off-chip sub-resistors.

In various embodiments, the passive electrical device is a Lange coupler comprising a plurality of ports, where one of the ports is an isolated port. Accordingly, the pre-matched power resistance system may be coupled to the isolated port of the Lange coupler, where the pre-matched power resistance system is configured to provide the predetermined input impedance of 50Ω across the predetermined target bandwidth, which may include 9 GHz to 12 GHz.

In various embodiments, the on-chip thin film resistor disposed on the substrate includes eight individual ones of the coplanar and adjacent sub-resistors. The eight individual ones of the coplanar sub-resistors may be rectangular-shaped and positioned parallel to one another.

In some embodiments, the tiered arrangement may include a first tier comprising a first portion of the manifold traces terminating in an electrical connection to a respective one of the coplanar sub-resistors, a second tier branching from the first tier, the second tier comprising a second portion of the manifold traces, and a third tier branching from the second tier, the third tier comprising a third portion of the manifold traces coupled to a feed line of the pre-matching network portion. Further, the first portion of the manifold traces may include a first, second, third, fourth, fifth, sixth, seventh, and eighth one of the manifold traces terminating in an electrical connection with a first, second, third, fourth, fifth, sixth, seventh, and eighth one of the co-planar sub-resistors, respectively.

The second portion of the manifold traces may include a ninth one of the manifold traces having a first end terminating in an electrical connection with the first and second one of the manifold traces and a second end terminating in an electrical connection with the third and fourth one of the manifold traces, and a tenth one of the manifold traces having a first end terminating in an electrical connection with the fifth and sixth one of the manifold traces and a second end terminating in an electrical connection with the seventh and eighth one of the manifold traces. The third portion of the manifold traces may include an eleventh one of the manifold traces having a first end terminating in an electrical connection with the ninth one of the manifold traces and a second end terminating in an electrical connection with the tenth one of the manifold traces, wherein an end of the feed line is physically and electrically connected to the eleventh one of the manifold traces.

In some embodiments, the pre-matching network portion includes a feed line, where the feed line may include a J-shaped portion or other suitable shape to compactly contain necessary pre-matching components within a desired area, along with a plurality of shunt capacitors coupled to the feed line or any other necessary electrical components required to tune and transform the nonideal resistor to the desired terminating impedance, which may be 50Ω or other suitable resistance.

In further embodiments, the passive electrical device is a Wilkinson power splitter and the pre-matched power resistance system is one of a plurality of pre-matched power resistance systems. For instance, a first end of a first transmission line of the Wilkinson power splitter is coupled to a first one of the pre-matched power resistance systems and a second end of the first transmission line of the Wilkinson power splitter is coupled to a second one of the pre-matched power resistance systems. Further, the Wilkinson power splitter may be a two-segment Wilkinson power splitter, where a first end of a second transmission line of the two-segment Wilkinson power splitter is coupled to a third one of the pre-matched power resistance systems, and a second end of the second transmission line of the two-segment Wilkinson power splitter is coupled to a fourth one of the pre-matched power resistance systems.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
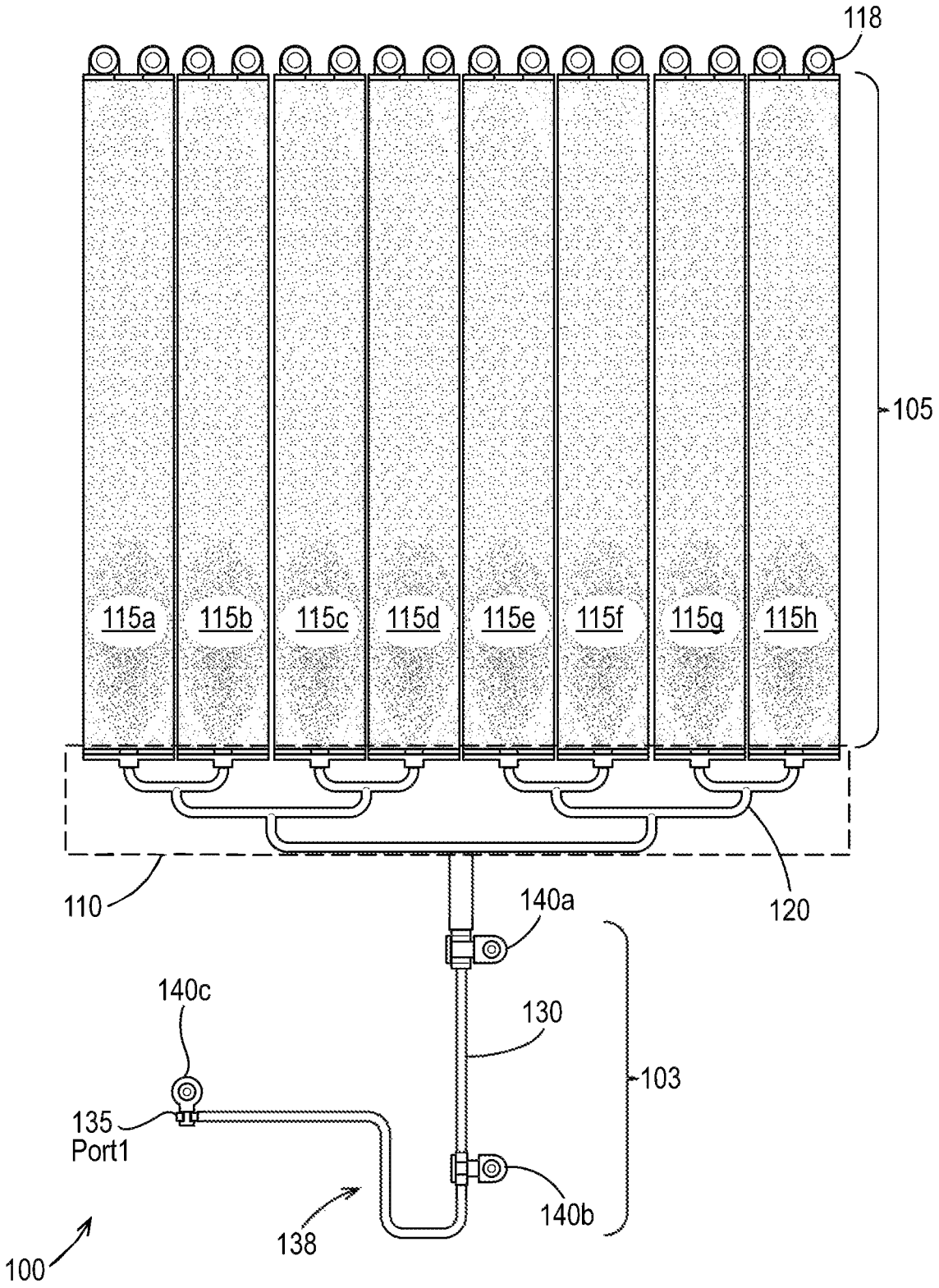
FIG. 1 is an image of a pre-matched power resistance system for use with an electrical device in accordance with various embodiments of the present disclosure, demonstrating uniform current distribution across the plurality of resistors due to an example manifold.

The present disclosure relates to a pre-matched power resistance system having a pre-matching network portion for use with a passive electrical device, such as a Lange coupler, a Wilkinson power splitter, or other passive electrical device as may be appreciated. Conventional Lange couplers, as well as other directional couplers, typically include a number of ports, such as four. In one example, these four ports include an input port, a through port, a coupled port, and an isolated port. The isolated port is usually terminated with a terminating resistor, which is usually a 50Ω resistor in radio-frequency (RF) applications. In practice, the terminating resistor coupled to the isolated port of a Lange coupler, especially for high power terminations, tends to be physically large and electrically mismatched due to the large parasitic reactances. High power handling requires a terminating resistor having a large area resistor body, which can cause excessive series and shunt parasitics.

Further, high power resistor terminations for Lange couplers, whether on-chip or off-chip, can be far from an ideal 50Ω that a Lange coupler requires for optimal performance. Power resistor terminations can be large and loaded with parasitic reactances that degrade its electrical performance, thereby degrading performance of the Lange coupler. Accordingly, various embodiments are described herein for a pre-matched power resistance system for use with a Lange coupler (or other electrical device). The pre-matched power resistance system overcomes these limitations, for instance, by including a manifold portion between a non-50Ω parasitic burdened load termination resistor and the Lange coupler. Further, a single resistor is split up into parallel resistors to disperse the current crowding typically exhibited in resistive planar materials.

Accordingly, various embodiments are described for a system that may include a passive electrical device and a pre-matched power resistance system electrically connected to the passive electrical device, where the pre-matched power resistance system is configured to provide the passive electrical device with a predetermined input impedance across a predetermined target bandwidth. As such, the pre-matched power resistance system may include a pre-matching network portion, an on-chip thin film resistor disposed on a substrate comprising a plurality of coplanar sub-resistors electrically isolated from one another, and a manifold portion comprising a plurality of manifold traces in a tiered arrangement terminating in an electrical connection to a respective one of the coplanar sub-resistors.

In various embodiments, the passive electrical device is a Lange coupler comprising a plurality of ports, where one of the ports is an isolated port. Accordingly, the pre-matched power resistance system may be coupled to the isolated port of the Lange coupler, where the pre-matched power resistance system is configured to provide the predetermined input impedance of 50Ω across the predetermined target bandwidth, which may include 9 GHz to 12 GHz, for example.

In various embodiments, the on-chip thin film resistor disposed on the substrate includes eight individual coplanar sub-resistors. The eight individual coplanar sub-resistors may be rectangular-shaped and positioned parallel to one another. The size of the resistors may be scaled according to specific applications or desired specifications.

In some embodiments, the tiered arrangement may include a first tier comprising a first portion of the manifold traces terminating in an electrical connection to a respective one of the coplanar sub-resistors, a second tier branching from the first tier, the second tier comprising a second portion of the manifold traces, and a third tier branching from the second tier, the third tier comprising a third portion of the manifold traces coupled to a feed line of the pre-matching network portion. Further, the first portion of the manifold traces may include a first, second, third, fourth, fifth, sixth, seventh, and eighth one of the manifold traces terminating in an electrical connection with a first, second, third, fourth, fifth, sixth, seventh, and eighth one of the co-planar sub-resistors, respectively.

The second portion of the manifold traces may include a ninth one of the manifold traces having a first end terminating in an electrical connection with the first and second one of the manifold traces and a second end terminating in an electrical connection with the third and fourth one of the manifold traces, and a tenth one of the manifold traces having a first end terminating in an electrical connection with the fifth and sixth one of the manifold traces and a second end terminating in an electrical connection with the seventh and eighth one of the manifold traces. The third portion of the manifold traces may include an eleventh one of the manifold traces having a first end terminating in an electrical connection with the ninth one of the manifold traces and a second end terminating in an electrical connection with the tenth one of the manifold traces, wherein an end of the feed line is physically and electrically connected to the eleventh one of the manifold traces.

In some embodiments, the pre-matching network portion includes a feed line, where the feed line may include a J-shaped portion or other suitable shape to compactly contain necessary pre-matching components within a desired area, along with a plurality of shunt capacitors coupled to the feed line or any other necessary electrical components required to tune and transform the nonideal resistor to the desired terminating impedance, which may be 50Ω or other suitable resistance.

In further embodiments, the passive electrical device is a Wilkinson power splitter and the pre-matched power resistance system is one of a plurality of pre-matched power resistance systems. For instance, a first end of a first transmission line of the Wilkinson power splitter is coupled to a first one of the pre-matched power resistance systems and a second end of the first transmission line of the Wilkinson power splitter is coupled to a second one of the pre-matched power resistance systems. Further, the Wilkinson power splitter may be a two-segment Wilkinson power splitter, where a first end of a second transmission line of the two-segment Wilkinson power splitter is coupled to a third one of the pre-matched power resistance systems, and a second end of the second transmission line of the two-segment Wilkinson power splitter is coupled to a fourth one of the pre-matched power resistance systems.

Turning now to FIG. 1, a thermal image of a pre-matched power resistance system 100 for use with an electrical device is shown in accordance with various embodiments of the present disclosure. The pre-matched power resistance system 100 is configured to provide a passive electrical device, such as a Lange coupler, a Wilkinson power splitter, or other suitable electrical device with a predetermined input impedance across a predetermined target bandwidth. The pre-matched power resistance system 100 is not drawn to scale in FIG. 1. In some cases, the pre-matched power resistance system 100 can include additional components or elements not shown in FIG. 1. The pre-matched power resistance system 100 can also omit one or more of the components shown in FIG. 1 in some cases.

As shown, the pre-matched power resistance system 100 may include a pre-matching network portion 103, a resistor portion 105, and a manifold portion 110. Starting first with the resistor portion 105, the resistor portion 105 may include an on-chip thin film resistor which may be disposed on a substrate in various embodiments. As shown in FIG. 1, the resistor portion 105 may include a plurality of sub-resistors 115*a* . . . 115*n* (collectively "sub-resistors 115") which may be coplanar, adjacent, and electrically isolated from one another in various embodiments.

In various embodiments, and as shown in FIG. 1, the resistor portion 105 may include eight individual ones of the sub-resistors 115 although, in alternative embodiments, another suitable number of sub-resistors 115 may be employed. In any event, in some embodiments, individual ones of the sub-resistors 115 may be rectangular-shaped, extending from one side of a substrate to another. Further, the sub-resistors 115 may be positioned parallel to one another, as shown in FIG. 1. In one example, the dimensions of the resistor portion 105, including a total width of all the sub-resistors 115 and a total height of all of the sub-resistors 115, is approximately 1,670 μm by 1,485 μm, but size of the resistor portion 105 can vary based on the particular purpose, design characteristics, design constraints, and other design factors for the pre-matched power resistance system 100.

Each of the sub-resistors 115 may be coupled to one or more vias 118 where, in FIG. 1, only a single via 118 is labeled for explanatory purposes. As shown in FIG. 1, however, each of the sub-resistors 115 may be coupled to two vias 118. In alternative embodiments, another suitable amount of vias 118 may be employed.

Moving along to the manifold portion 110, the manifold portion 110 may include a plurality of manifold traces 120. In various embodiments, the manifold traces 120 are in a tiered arrangement or, in other words, a hierarchical arrangement, and may terminate in an electrical connection to a respective one of the sub-resistors 115. In various embodiments, the manifold traces 120 include metallic or conductive traces disposed on a substrate, as may be appreciated. Further, in some embodiments, the tiered arrangement is symmetrical or substantially symmetrical although, in practice, it is understood that the manifold traces 120 may include various offsets to optimize the pre-matched power resistance system 100.

The pre-matching network portion 103 may include a feed line 130, which couples the resistor portion 105 and the manifold portion 110 to a port 135 (e.g., "Port 1"). Like the manifold traces 120, the feed line 130 may include one or more metallic or conductive traces disposed on a substrate, as may be appreciated. The pre-matching network 103 may take any shape or specific electrical topology as necessary to impedance match (or transform as it is called) the terminating resistor to the desired impedance (typically 50Ω) required by the Lange coupler or Wilkinson combiner (typically 100Ω, or 2 Zo, if the system characteristic impedance is not 50Ω).

To this end, in some embodiments, the pre-matching network portion 103 includes a feed line 130 having a J-shaped portion 138 although, in other embodiments, the feed line may be or include another suitable shape to compactly contain necessary pre-matching components within a desired area, along with a plurality of shunt capacitors coupled to the feed line or any other necessary electrical components required to tune and transform the nonideal resistor to the desired terminating impedance, which may be 50Ω or other suitable resistance.

In various embodiments, the pre-matching network portion 103 includes one or more shunt capacitors 140*a* . . . 140*c* (collectively "shunt capacitors 140"). For instance, the feed line 130 may be electrically coupled to the one or more shunt capacitors 140. In the non-limiting example of FIG. 1, the pre-matching network portion 103 may include three shunt capacitors 140 although other suitable number of shunt capacitors 140 may be employed. For instance, one to ten shunt capacitors 140 can be employed. In any event, the shunt capacitors 140 form a matching network which is an impedance-transformed resistor block of 50Ω at the port 135 (e.g., "Port 1"). In other words, the pre-matched power resistance system 100 absorbs reactances and non-50Ω properties of a power termination resistor and transforms it to 50Ω over a predetermined bandwidth.

The manifold portion 110, which manifolds the wide resistor body (e.g., the resistor portion 105), introduces equal phase distribution of an incoming power wave incident onto the breadth of the resistor portion 105. By introducing more feed points across the resistor body, current crowding is prevented and heating is localized, for instance, using a single tap point to inject reflected power from a Lange coupler or other electrical device.

In high-conducting metals at high frequencies, current crowds to the edges of a conductor in a microstrip. As such, a body of a resistor portion 105 is also split into equal segments, e.g., the sub-resistors 115 that are electrically isolated with respect to one another, to minimize edge current crowding. With some resistor materials, this is less of a problem; however, relatively wide and low impedance resistive materials are used to form a resistor body within a monolithic microwave integrated circuit (MMIC). This embodiment can be extended to PCBs, where a terminating resistor of a PCB can include a plurality of parallel surface mount resistors being fed by a equi-phase manifolding network fed from a pre-matching network comprised of shunt tuning capacitors or other needed reactive lumped or distributed elements.

Figure 5:
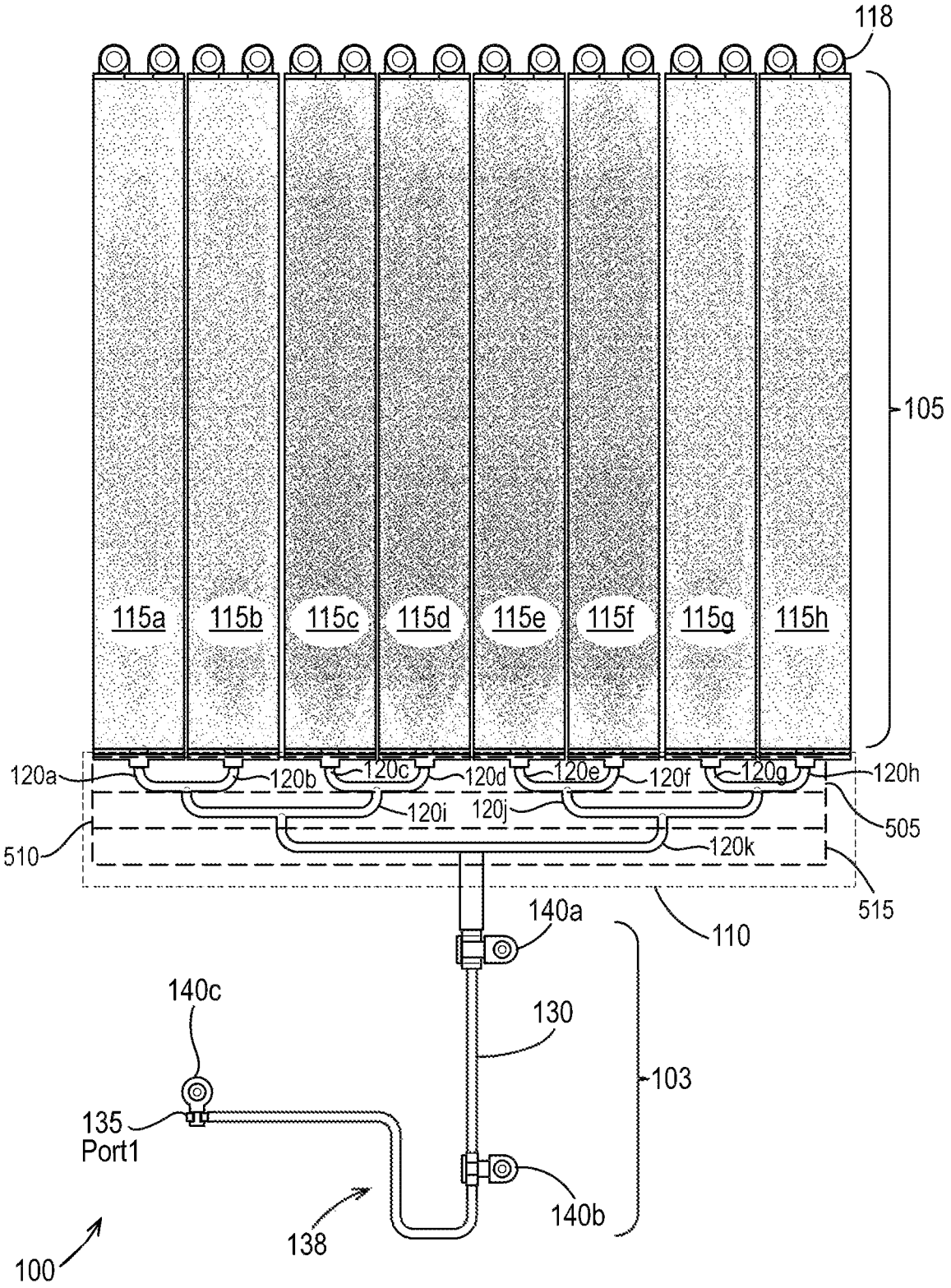
FIG. 5 is another image of the pre-matched power resistance system of FIG. 1 for use with an electrical device in accordance with various embodiments of the present disclosure.

The thermal image of the pre-matched power resistance system 100 shown in FIG. 1 illustrates heat occurring in the sub-resistors 115 at a 9 GHz frequency, whereas the thermal image of the pre-matched power resistance system 100 of FIG. 5 illustrates heat occurring in the sub-resistors 115 at a 12 GHz frequency. It is understood, however, that other target frequencies may be employed.

While FIG. 1 shows a specific embodiment for a pre-matched power resistance system 100, it is understood that other configurations and combinations of on-chip and off-chip components that, when combined, form a high power composite termination resistor, feeding manifold, and pre-matching network. For instance, while FIG. 1 shows an on-chip implementation, all or a portion of the components of the pre-matched power resistance system 100 can be implemented off chip using surface mount resistors, for example, on a PCB, fed by a manifold and pre-matching network, or any combination of on-chip and off-chip components. In some embodiments, a PCB can include a group of parallel surface mount (SMT) resistors and lines and SMT caps for tuning and/or pre-matching.

Figure 2:
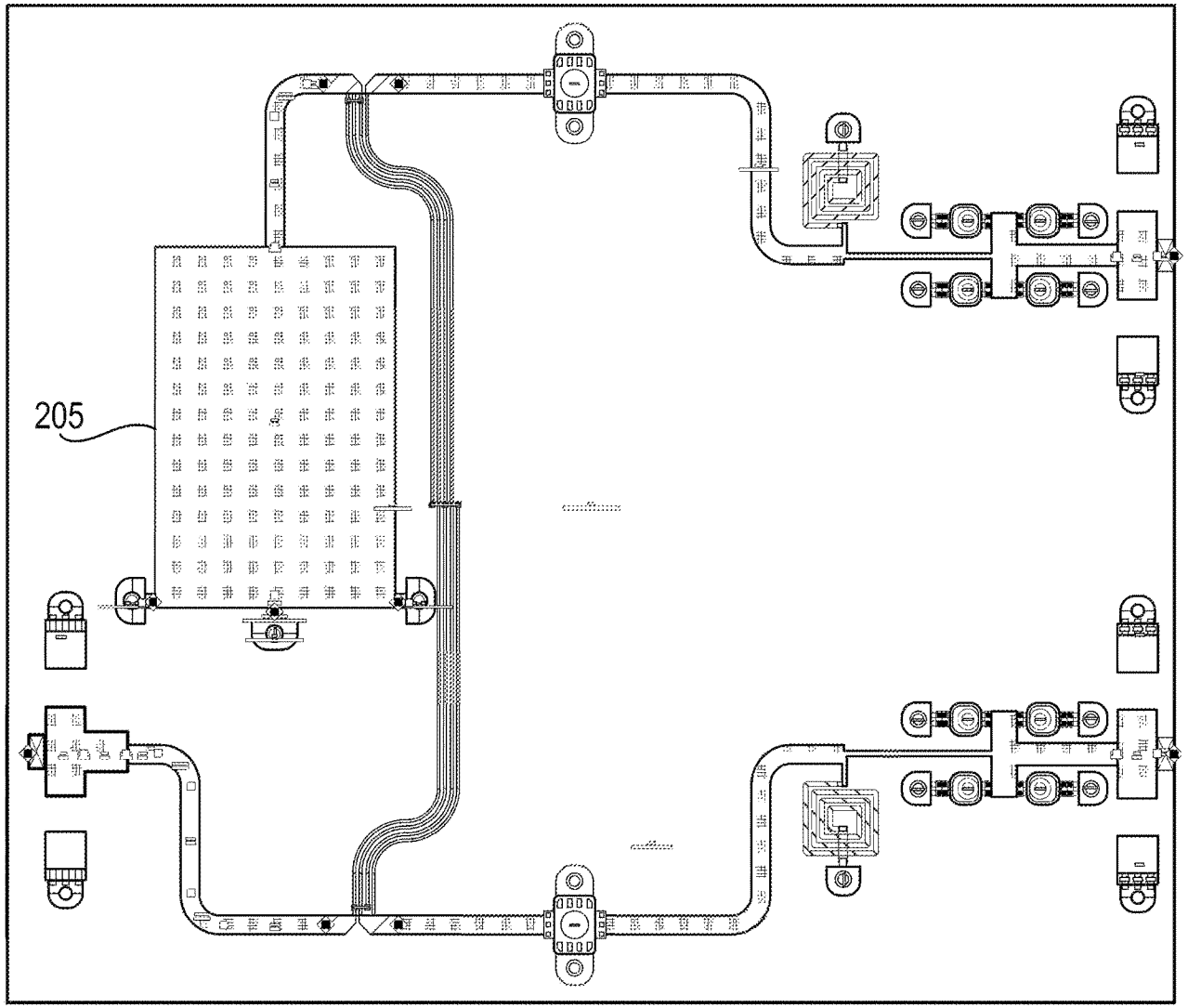
(PRIOR ART) FIG. 2
FIG. 2 is a schematic diagram of a chip or other circuit having a conventional wide area resistor that is large, but electrically impedance mismatched due to the undesired parasitics.

Referring now to FIG. 2, a schematic diagram 200 of a chip or other circuit is shown as having a conventional on-chip thin-film resistor (TFR) terminating resistor 205 in accordance with various embodiments of the present disclosure. With a terminating resistor 205 that is very large, the terminating resistor 205 is electrically burdened with significant parasitics, making it far from an ideal 50Ω that is desired for a Lange coupler or other electrical device. Accordingly, the pre-matched power resistance system 100 described above with respect to FIG. 1 includes a compact multipole matching network that can effectively absorb the non-50Ω behavior of a load resistor and transform it into a very high-quality 50Ω for a Lange coupler, Wilkinson power splitter, or other passive electrical device.

Figure 3:
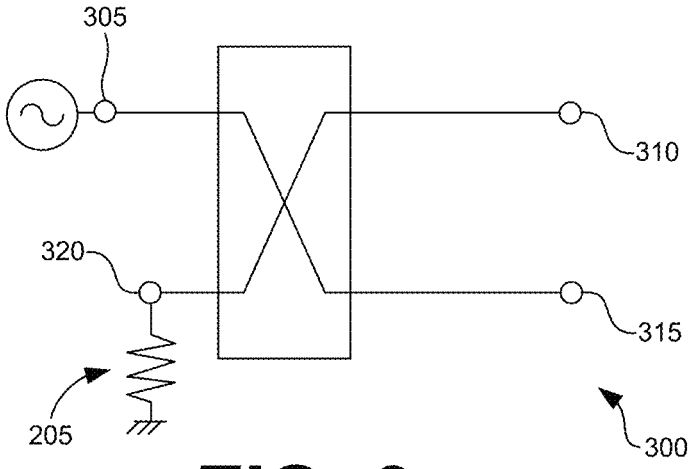
FIG. 3 ( PRIOR ART )
FIG. 3 is a circuit diagram of a conventional Lange coupler.

Referring now to FIG. 3, a circuit diagram of a conventional Lange coupler 300 is shown. The Lange coupler includes four ports, namely, an input port 305, a through port 310, a coupled port 315, and an isolated port 320. The isolated port 320 is usually terminated with a terminating resistor 205. The terminating resistor 205 coupled to the isolated port 320 of the Lange coupler 300 tends to be physically and electrically large, as shown in FIG. 2. However, a physically and electrically large type of terminating resistor 205 causes large parasitic reactances. High power handling requires a terminating resistor 205 having a large area resistor body, which can cause excessive series and shunt parasitics.

Figure 4:
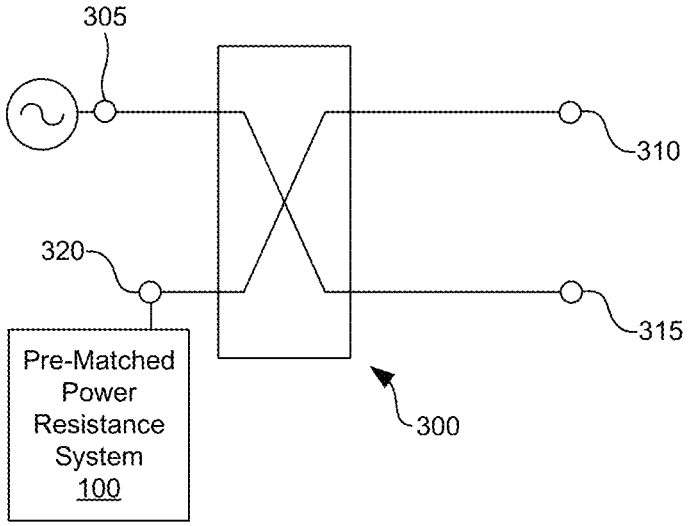
FIG. 4 is a circuit diagram of a Lange coupler electrically coupled to the pre-matched power resistance system of FIG. 1 in accordance with various embodiments of the present disclosure.

Moving along to FIG. 4, a circuit diagram of a system 400 comprising a Lange coupler 300 electrically coupled to the pre-matched power resistance system 100 of FIG. 1 in accordance with various embodiments of the present disclosure. Specifically, the pre-matched power resistance system 100 may be coupled to the isolated port 320, for instance, in place of a terminating resistor 205. The pre-matched power resistance system 100 described herein includes a multipole matching network that can effectively absorb the non-50Ω behavior of a terminating resistor 205 and transform it into a very high-quality 50Ω for the Lange coupler 300 or other electrical device requiring a terminating resistor 205.

To this end, the pre-matched power resistance system 100 may be coupled to the isolated port 320 of the Lange coupler 300, where the pre-matched power resistance system 100 is configured to provide the predetermined input impedance of 50Ω across the predetermined target bandwidth, which may include 9 GHz to 12 GHz. Accordingly, the pre-matched power resistance system 100 provides a designer with the ability to use almost any termination resistor 205 needed for power dissipation requirements regardless of the amount of nonideality that the terminating resistor 205 presents to the Lange coupler 300 or other electrical device.

In FIG. 5, another image of the current distribution within the pre-matched power resistance system 100 is shown in accordance with various embodiments of the present disclosure. The image of the pre-matched power resistance system 100 of FIG. 5 effectively illustrates heat generation within the sub-resistors 115 at a 12 GHz frequency, whereas the thermal image of the pre-matched power resistance system 100 shown in FIG. 1 effectively illustrates heat occurring in the sub-resistors 115 at a 9 GHz frequency. Again, it is understood that other target frequencies may be employed.

Figure 8:
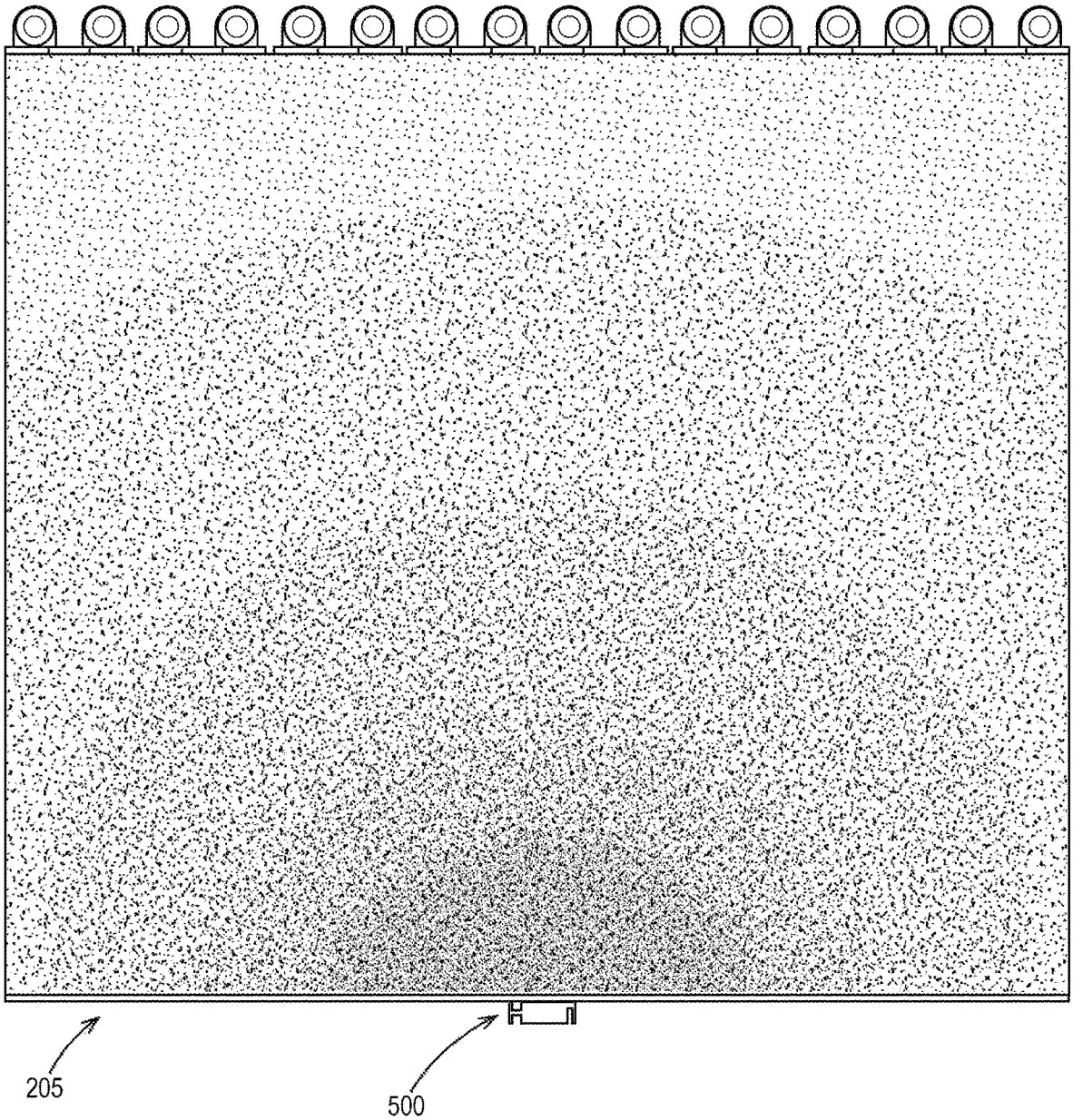
(PRIOR ART) FIG. 8
FIG. 8 is an image of a current density within a conventional wide area resistor being fed from a central injection point causing nonuniform utilization of the resistor and localized current crowding.

Referring to FIG. 8, a conventional-type of terminating resistor 205 is shown having a wide area body, like that of FIG. 2. A center tap type of terminating resistor 205 causes high current flow to occur and concentrate near a feed point 500, which causes localized overheating. As such, only the portion of the terminating resistor 205 near the feed point 500 generates the most heat, whereas other portions of the terminating resistor 205 generate little to no heat. The thermal differences between the center tap type of terminating resistor 205 and the pre-matched power resistance system 100 can be observed based on a comparison of FIG. 8 and FIG. 1.

Figure 6:
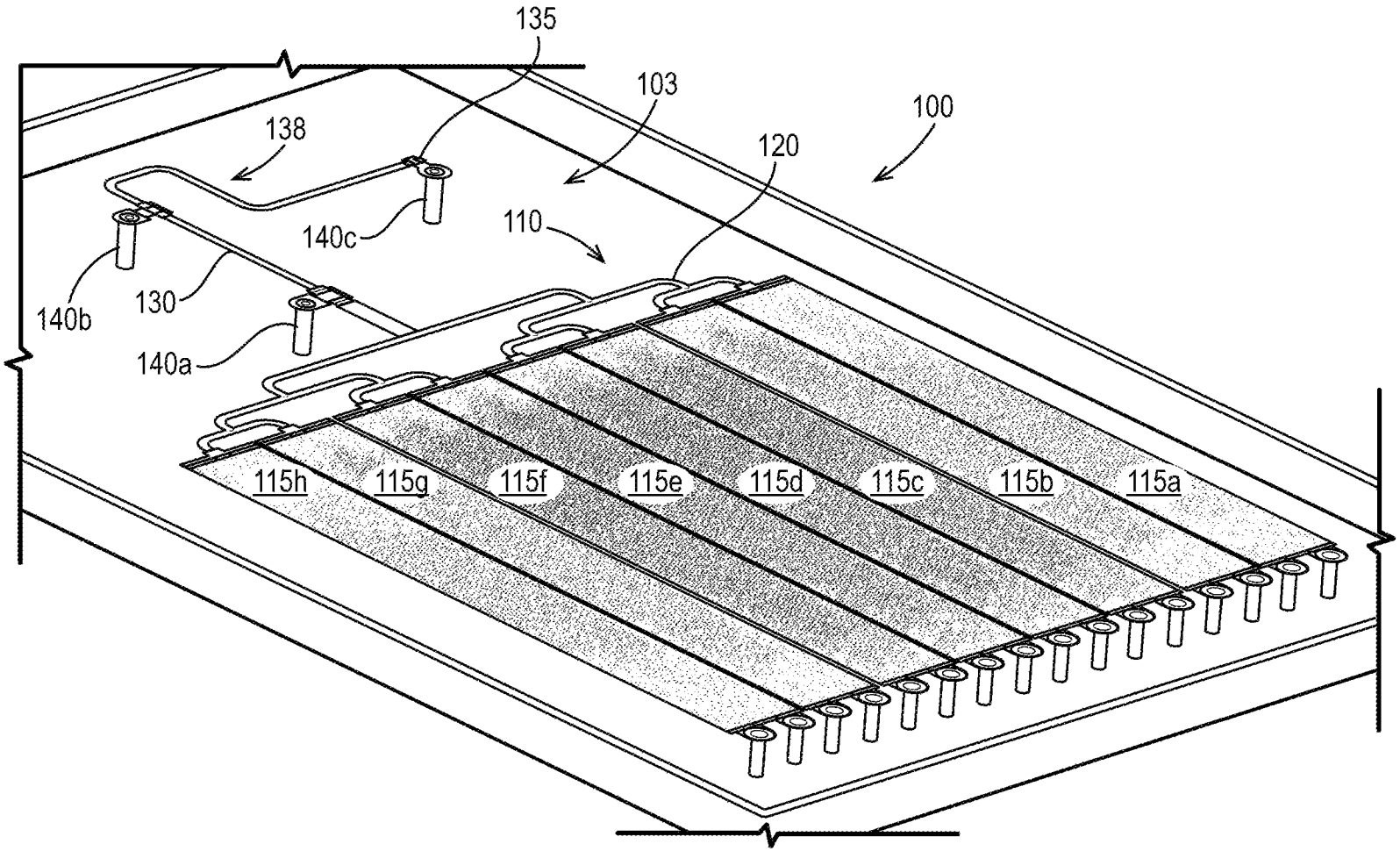
FIG. 6 is a perspective image of current density within the pre-matched power resistance system of FIG. 1 for use with an electrical device in accordance with various embodiments of the present disclosure.

Turning back to FIG. 6, a perspective image of the current distribution within the pre-matched power resistance system 100 is shown in accordance with various embodiments of the present disclosure. Referring now to FIGS. 5 and 6 collectively, the resistor portion 105, fed by the manifold portion 110, promotes a uniform current flow across the body of the sub-resistors 115, as is evident when viewing FIG. 5. Further, in some embodiments, the tiered arrangement may include a first tier 505, a second tier 510, and a third tier 515 although, in alternative embodiments, other suitable number of tiers may be employed.

The first tier 505 may include a first portion of the manifold traces 120 terminating in an electrical connection to a respective one of the sub-resistors 115. The second tier 510 may branch outward from the first tier 505, where the second tier 510 includes a second portion of the manifold traces 120. Further, the third tier 515 may branch outward from the second tier 510. The third tier 515 may include a third portion of the manifold traces 120 and may be coupled to the feed line 130.

The first portion of the manifold traces 120 in the first tier 505 may include a first manifold trace 120*a*, a second manifold trace 120*b*, a third manifold trace 120*c*, a fourth manifold trace 120*d*, a fifth manifold trace 120*e*, a sixth manifold trace 120*f*, a seventh manifold trace 120*g*, and an eighth manifold trace 120*h*, each of which terminating in an electrical connection with a first sub-resistor 115*a*, a second sub-resistor 115*b*, a third sub-resistor 115*c*, a fourth sub-resistor 115*d*, a fifth sub-resistor 115*e*, a sixth sub-resistor 115*f*, a seventh sub-resistor 115*g*, and an eighth sub-resistor 115*h*, respectively, as shown in FIGS. 1 and 5.

The second portion of the manifold traces 120 in the second tier 510 may include a ninth manifold trace 120*i* having a first end terminating in an electrical connection with the first manifold trace 120*a* and the second manifold trace 120*b*, and a second end terminating in an electrical connection with the third manifold trace 120*c* and the fourth manifold trace 120*d*. Also, the second tier 510 may include a tenth manifold trace 120*j* having a first end terminating in an electrical connection with the fifth manifold trace 120*e* and the sixth manifold trace 120*f*, and a second end terminating in an electrical connection with the seventh manifold trace 120*g* and the eighth manifold trace 120*h*.

The third portion of the manifold traces 120 in the third tier 515, for instance, may include an eleventh manifold trace 120*k*. The eleventh manifold trace 120*k* may include a first end terminating in an electrical connection with the ninth manifold trace 120*i* and a second end terminating in an electrical connection with the tenth manifold trace 120*j*. An end of the feed line 130 may physically and electrically connect to the eleventh manifold trace 120*k*.

The first manifold trace 120*a* and the second manifold trace 120*b* may together form a U-shaped, T-shaped, or Y-Shaped manifold trace 120, as may be appreciated. Similarly, the third manifold trace 120*c* and the fourth manifold trace 120*d* may together form a U-shaped, T-shaped, or Y-Shaped manifold trace 120, the fifth manifold trace 120*e* and the sixth manifold trace 120*f* may together form a U-shaped, T-shaped, or Y-Shaped manifold trace 120, and the seventh manifold trace 120*g* and the eighth manifold trace 120*h* may together form a U-shaped, T-shaped, or Y-Shaped manifold trace 120.

Figure 7:
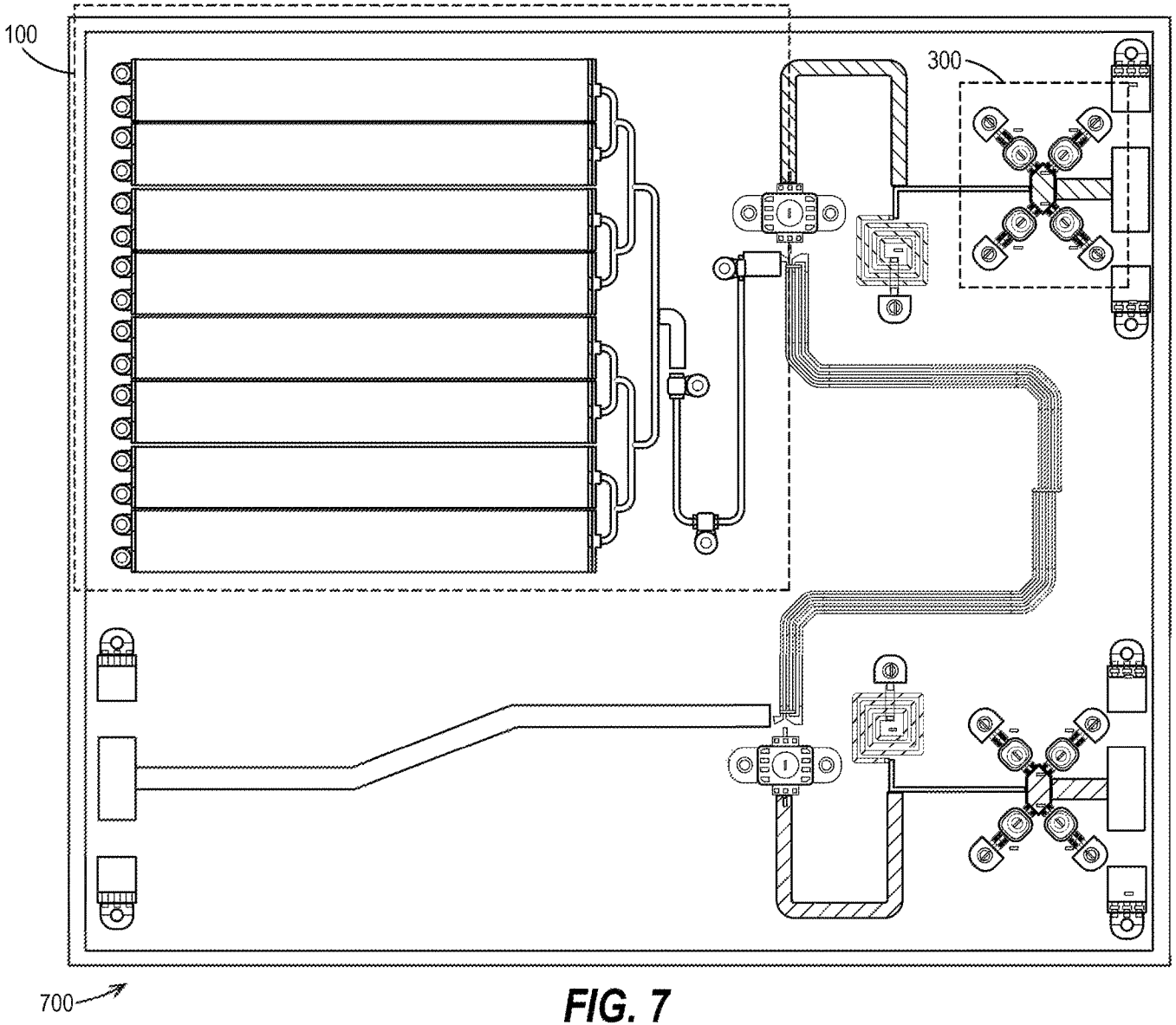
FIG. 7 is a circuit diagram of a Lange coupler electrically coupled to the pre-matched power resistance system of FIG. 1 in accordance with various embodiments of the present disclosure.

Referring next to FIG. 7, a circuit diagram 700 is shown including a Lange coupler 300 electrically coupled to the pre-matched power resistance system 100 in accordance with various embodiments of the present disclosure. As shown in FIG. 7, the pre-matched power resistance system 100 does not consume more space on a substrate as compared to a terminating resistor 205 (see FIG. 2), but provides better performance when used with a passive electrical device, such as a Lange coupler 300.

Figure 9:
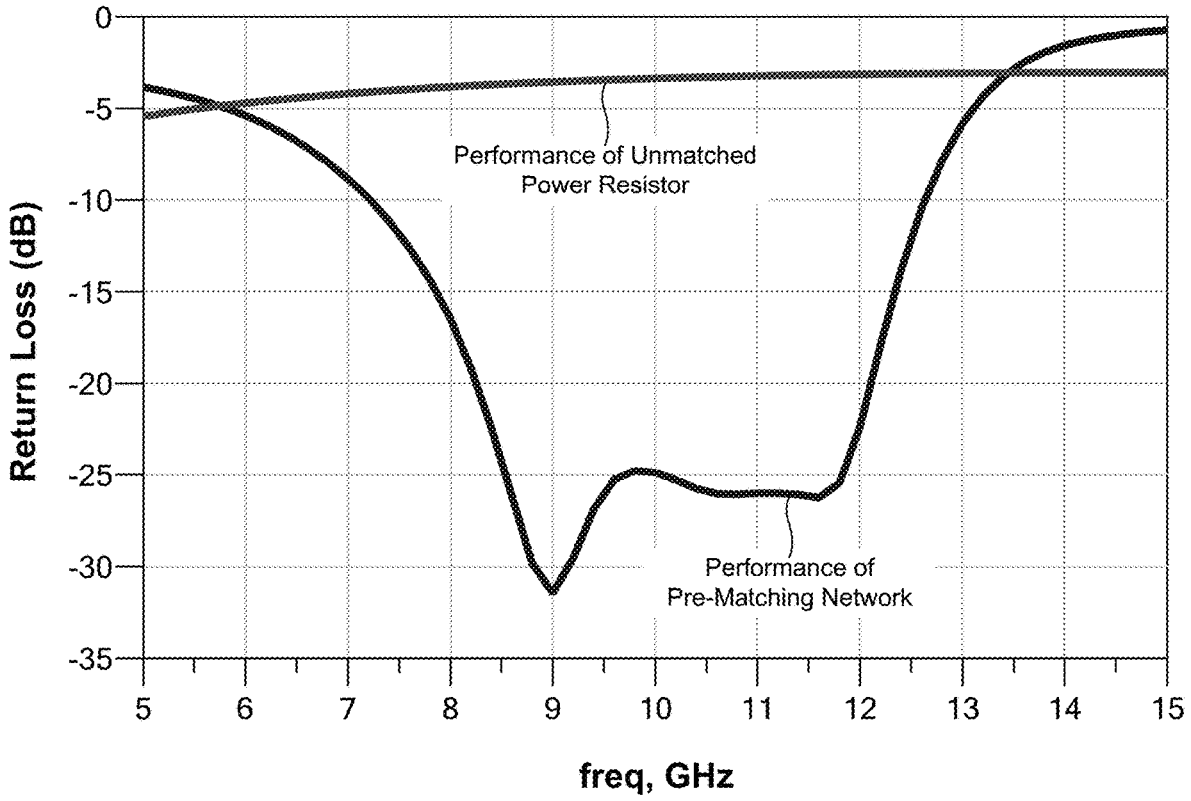
FIGS. 9 and 10 are charts comparing the electrical return loss against a target 50Ω impedance for a typical unmatched power resistor to the pre-matched power resistance system in use with a Lange coupler in accordance with various embodiments of the present disclosure.
Figure 10:
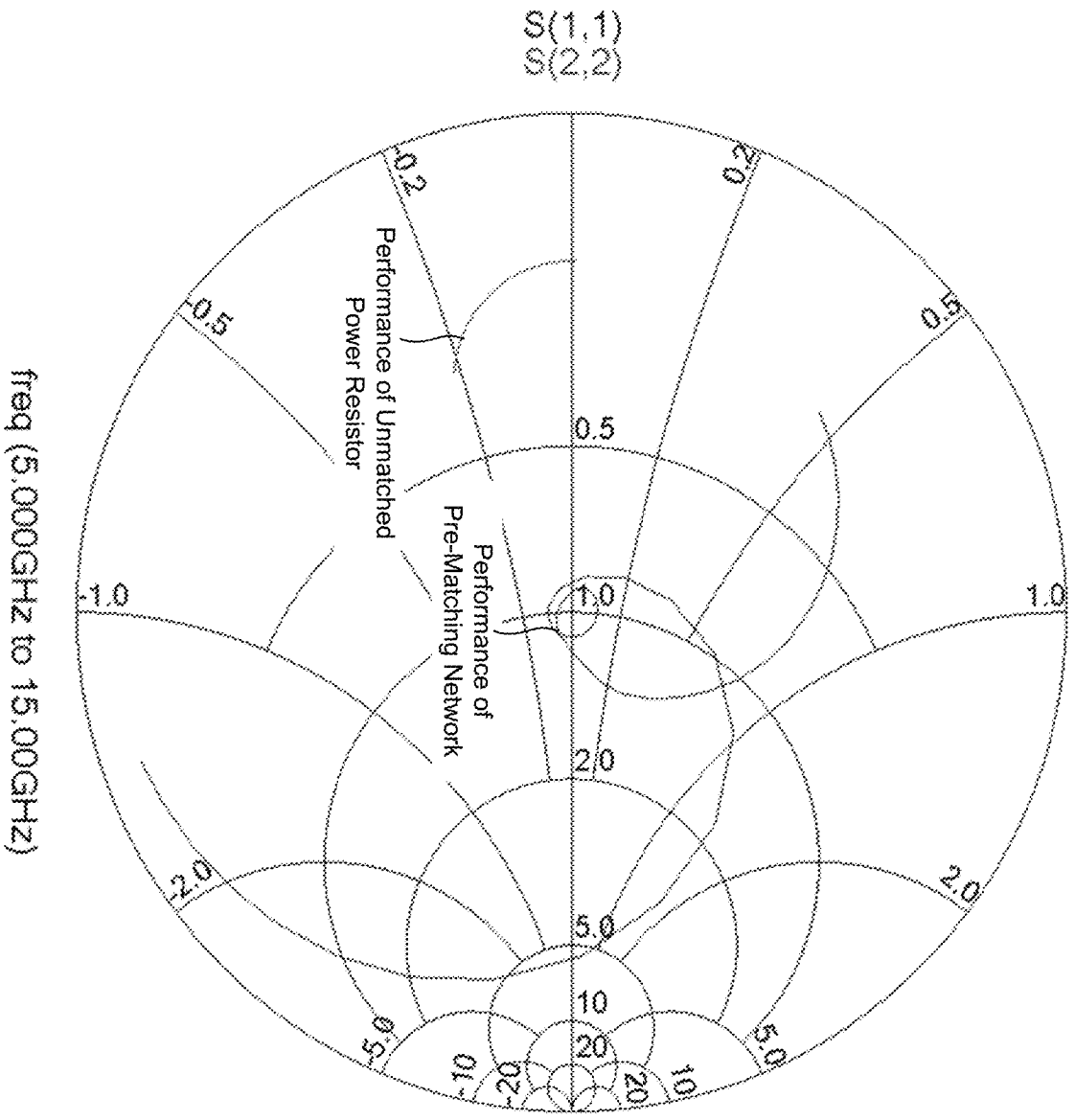

FIGS. 9 and 10 are example charts comparing performance metrics of an unmatched power resistor (e.g., a conventional terminating resistor 205) to the pre-matched power resistance system 100 in use with a Lange coupler 300 in accordance with various embodiments of the present disclosure. As shown in FIG. 9, the return loss performance of the pre-matched power resistance system 100 is preferable as compared to the performance of the unmatched power resistor. Referring to FIG. 10, the unmatched resistor in this example has an effective input impedance of 15Ω and 0.75 pF at 9 GHz, which is less than ideal. The pre-matched power resistance system 100 has a relatively better power match to the Lange coupler 300 as shown. FIGS. 9 and 10 provide one example of the characteristics and performance possible with the pre-matched power resistance system 100 in use with the Lange coupler 300, although the performance can vary within the scope of the embodiments based on design variations.

Figure 11A:
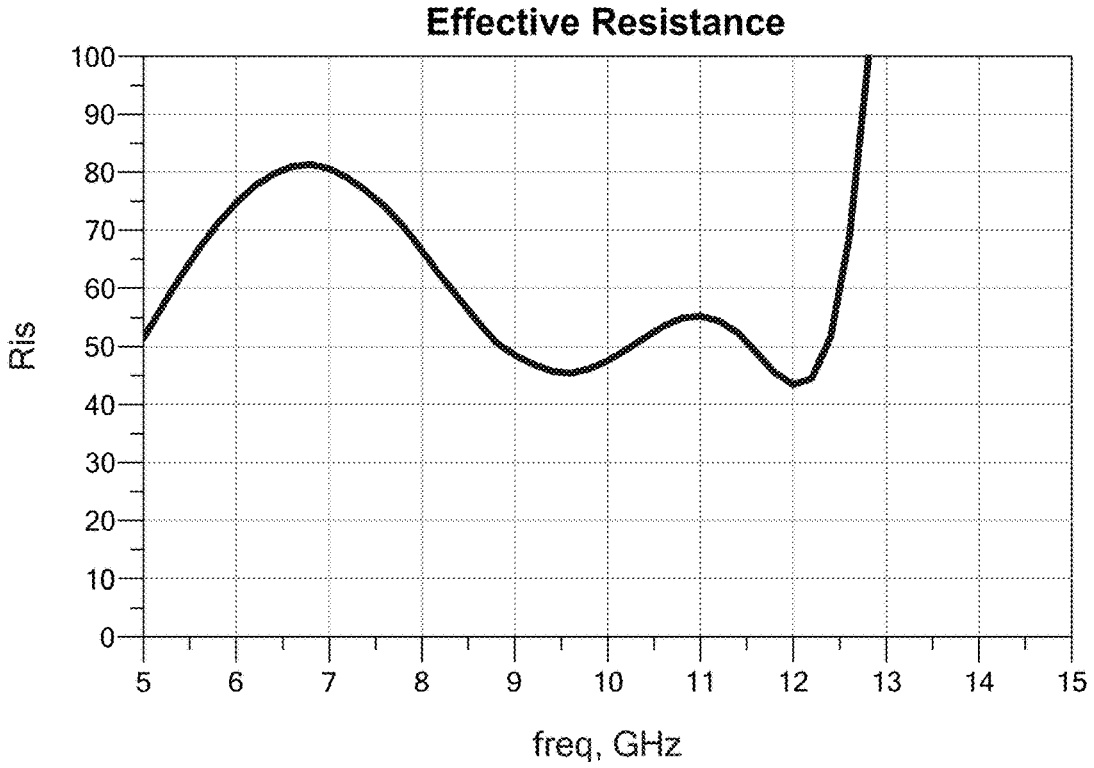
FIG. 11A is a chart showing an effective resistance of the pre-matched power resistance system in accordance with various embodiments of the present disclosure.
Figure 11B:
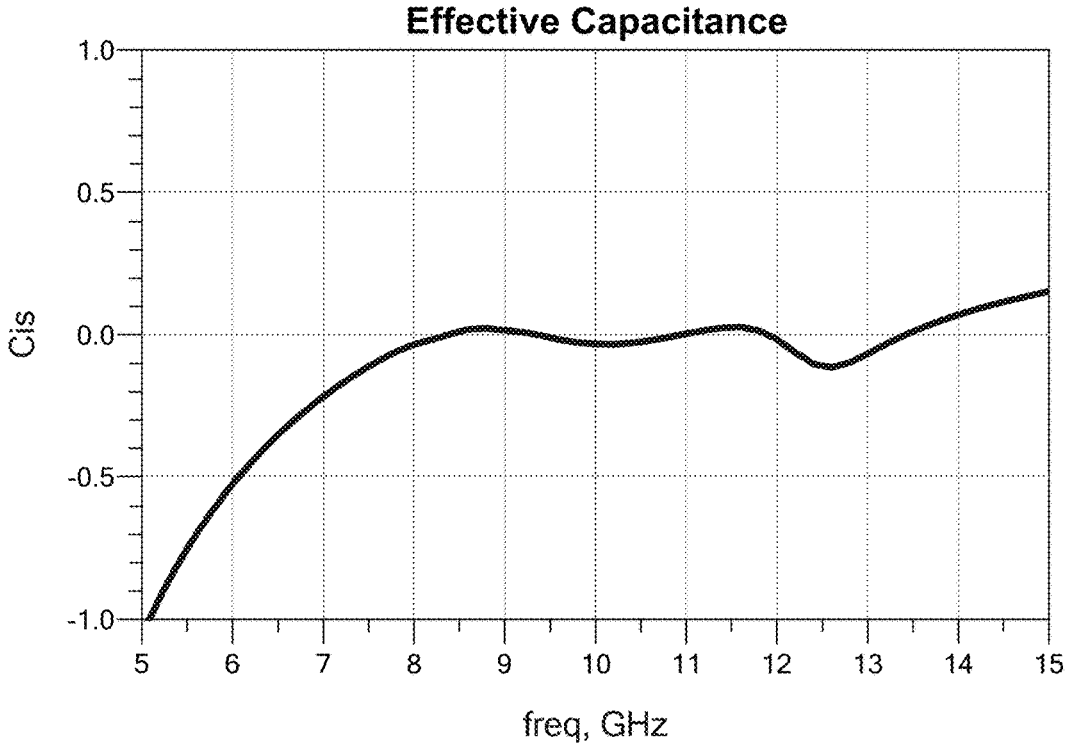
FIG. 11B is a chart showing an effective capacitance of the pre-matched power resistance system in accordance with various embodiments of the present disclosure.

Turning now to FIGS. 11A-11B, FIG. 11A is an example chart showing an effective resistance of the pre-matched power resistance system 100, and FIG. 11B is an example chart showing an effective capacitance of the pre-matched power resistance system 100 in accordance with various embodiments of the present disclosure. The charts of FIGS. 11A-11B show great performance with respect to effective resistance and capacitance, as well with respect to input return loss. FIGS. 11A-11B provide one example of the characteristics and performance possible with the pre-matched power resistance system 100, although the performance can vary within the scope of the embodiments based on design variations.

Figure 12:
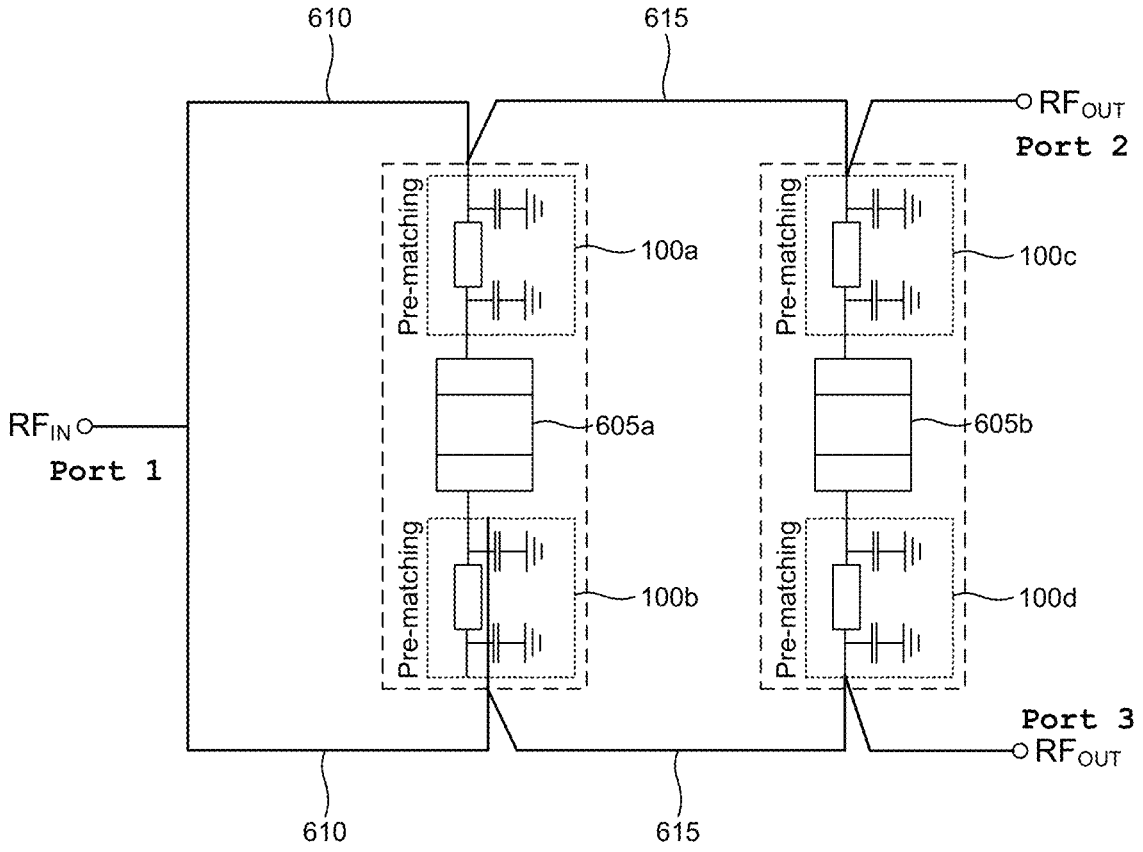
FIG. 12 is an example circuit diagram of a two-segment Wilkinson power splitter using a plurality of the pre-matched power resistance system in accordance with various embodiments of the present disclosure.

FIG. 12 is an example circuit diagram of a two-segment Wilkinson power splitter 600 using a plurality of the pre-matched power resistor systems 100*a* . . . 100*d* (or, alternatively, just a plurality of pre-matching network portions 103) in accordance with various embodiments of the present disclosure. For instance, in some embodiments, the passive electrical device described herein includes a Wilkinson power splitter 600 and the pre-matched power resistance system 100, as shown in FIG. 1, which is one of a plurality of pre-matched power resistance systems 100.

As shown in FIG. 12, a first end of a first transmission line 610 of the Wilkinson power splitter 600 is coupled to a first one of the pre-matched power resistance systems 100*a* and a second end of the first transmission line 610 is coupled to a second one of the pre-matched power resistance systems 100*b*. Further, the Wilkinson power splitter 600 may be a two-segment Wilkinson power splitter, where a first end of a second transmission line 615 thereof is coupled to a third one of the pre-matched power resistance systems 100*c*, and a second end of the second transmission line 615 is coupled to a fourth one of the pre-matched power resistance systems 100*d*. The first balance resistor 605*a* may be positioned in series or otherwise between the first one of the pre-matched power resistance systems 100*a* and the second one of the pre-matched power resistance systems 100*b*, whereas the second balance resistor 605*b* may be positioned in series or otherwise between the third one of the pre-matched power resistance systems 100*c* and the fourth one of the pre-matched power resistance systems 100*d*.

Further, in accordance with various embodiments, a method is described that can include forming a chip or other electrical device having the pre-matched power resistance system 100 described herein and/or one or more passive electrical devices, such as a Lange coupler 300, a Wilkinson power splitter 600, or other known divider, coupler, or splitter. The method may include providing the pre-matched power resistance system 100 on a chip, where the pre-matched power resistance system 100 is configured to provide a predetermined input impedance across a predetermined target bandwidth. The method may further include electrically coupling the pre-matched power resistance system 100 to the passive electrical device.

The features, structures, or characteristics described above may be combined in one or more embodiments in any suitable manner, and the features discussed in the various embodiments are interchangeable, if possible. In the following description, numerous specific details are provided in order to fully understand the embodiments of the present disclosure. However, a person skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

Although the relative terms such as "on," "below," "upper," and "lower" are used in the specification to describe the relative relationship of one component to another component, these terms are used in this specification for convenience only, for example, as a direction in an example shown in the drawings. It should be understood that if the device is turned upside down, the "upper" component described above will become a "lower" component. When a structure is "on" another structure, it is possible that the structure is integrally formed on another structure, or that the structure is "directly" disposed on another structure, or that the structure is "indirectly" disposed on the other structure through other structures.

In this specification, the terms such as "a," "an," "the," and "said" are used to indicate the presence of one or more elements and components. The terms "comprise," "include," "have," "contain," and their variants are used to be open ended, and are meant to include additional elements, components, etc., in addition to the listed elements, components, etc. unless otherwise specified in the appended claims. The terms "first," "second," etc. are used only as labels, rather than a limitation for a number of the objects.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A system, comprising:

a passive electrical device; and a pre-matched power resistance system electrically connected to the passive electrical device, the pre-matched power resistance system providing the passive electrical device with a predetermined input impedance across a predetermined bandwidth, the pre-matched power resistance system comprising:

a pre-matching network portion;

a resistor disposed on a substrate comprising a plurality of sub-resistors; and a manifold portion comprising a plurality of manifold traces in a tiered arrangement, each of the plurality of sub-resistors being coupled to a respective one of the plurality of manifold traces.

2. The system of claim 1, wherein:

the passive electrical device is a Lange coupler comprising a plurality of ports, one of the ports being an isolated port; and the pre-matched power resistance system is coupled to the isolated port of the Lange coupler, the pre-matched power resistance system providing a predetermined input impedance across the predetermined bandwidth.

3. The system of claim 2, wherein the predetermined input impedance is 50Ω to 100Ω and the predetermined bandwidth is 9 GHz to 12 GHz.

4. The system of claim 1, wherein the resistor comprises an on-chip thin film resistor disposed on the substrate, and the plurality of sub-resistors comprise eight sub-resistors.

5. The system of claim 1, wherein individual ones of the plurality of sub-resistors are rectangular-shaped and are positioned parallel to one another.

6. The system of claim 1, wherein the tiered arrangement comprises:

a first tier comprising a first number of the plurality of manifold traces coupled to the plurality of sub-resistors;

a second tier branching from the first tier, the second tier comprising a second number of the plurality of manifold traces; and a third tier branching from the second tier and coupled to a feed line of the pre-matching network portion, the third tier comprising a third number of the plurality of manifold traces.

7. The system of claim 6, wherein:

the first number of the plurality of manifold traces comprises a first, second, third, fourth, fifth, sixth, seventh, and eighth manifold trace terminating in a coupling with a first, second, third, fourth, fifth, sixth, seventh, and eighth sub-resistor of the plurality of sub-resistors, respectively;

the second number of the manifold traces comprises:

a ninth manifold trace having a first end coupled with the first and second manifold traces and a second end coupled with the third and fourth manifold traces; and a tenth manifold trace having a first end coupled with the fifth and sixth manifold traces and a second end coupled with the seventh and eighth manifold traces; and the third number of the manifold traces comprises an eleventh manifold trace having a first end coupled with the ninth manifold trace and a second end coupled with the tenth manifold trace, wherein an end of the feed line is coupled the eleventh manifold trace.

8. The system of claim 6, wherein the pre-matching network portion comprises:

the feed line, wherein the feed line impedance transforms the resistor to a predetermined impedance across the predetermined bandwidth; and a plurality of shunt capacitors coupled to the feed line.

9. The system of claim 1, wherein:

the passive electrical device is a Wilkinson power splitter comprising a predetermined number of segments;

the pre-matched power resistance system is one of a plurality of pre-matched power resistance systems;

a first end of a first transmission line of the Wilkinson power splitter is coupled to a first one of the plurality of pre-matched power resistance systems; and a second end of the first transmission line of the Wilkinson power splitter is coupled to a second one of the plurality of pre-matched power resistance systems.

10. The system of claim 9, wherein:

the Wilkinson power splitter is a two-segment Wilkinson power splitter;

a first end of a second transmission line of the two-segment Wilkinson power splitter is coupled to a third one of the plurality of pre-matched power resistance systems; and a second end of the second transmission line of the two-segment Wilkinson power splitter is coupled to a fourth one of the plurality of pre-matched power resistance systems.

11. A method for pre-matched power resistance, comprising:

providing a pre-matched power resistance system, the pre-matched power resistance system providing a predetermined input impedance across a predetermined bandwidth, the pre-matched power resistance system comprising:

a pre-matching network portion;

a resistor disposed on a substrate comprising a plurality of sub-resistors; and a manifold portion comprising a plurality of manifold traces in a tiered arrangement, each of the plurality of sub-resistors being coupled to a respective one of the plurality of manifold traces; and coupling the pre-matching network portion to a passive electrical device.

12. The method of claim 11, further comprising:

coupling the pre-matched power resistance system to an isolated port of a Lange coupler, wherein the pre-matched power resistance system provides a predetermined input impedance across a predetermined bandwidth.

13. A pre-matched power resistance system that provides a predetermined input impedance, comprising:

a pre-matching network portion;

a resistor disposed on a substrate comprising a plurality of sub-resistors; and a manifold portion comprising a plurality of manifold traces in a tiered arrangement, each of the plurality of sub-resistors being coupled to a respective one of the plurality of manifold traces.

14. The pre-matched power resistance system of claim 13, wherein:

the pre-matched power resistance system is coupled to an isolated port of a Lange coupler; and the pre-matched power resistance system provides a predetermined input impedance across a predetermined bandwidth.

15. The pre-matched power resistance system of claim 13, wherein the resistor comprises eight sub-resistors.

16. The pre-matched power resistance system of claim 13, wherein individual ones of the plurality of sub-resistors are rectangular-shaped and are positioned parallel to one another.

17. The pre-matched power resistance system of claim 13, wherein the tiered arrangement comprises:

a first tier comprising a first number of the plurality of manifold traces coupled to the plurality of sub-resistors;

a second tier branching from the first tier, the second tier comprising a second number of the plurality of manifold traces; and a third tier branching from the second tier and coupled to a feed line of the pre-matching network portion, the third tier comprising a third number of the plurality of manifold traces.

18. The system of claim 17, wherein:

the first number of the plurality of manifold traces comprises a first, second, third, fourth, fifth, sixth, seventh, and eighth manifold trace coupled terminating in a coupling with a first, second, third, fourth, fifth, sixth, seventh, and eighth sub-resistor of the plurality of sub-resistors, respectively;

the second number of the manifold traces comprises:

a ninth manifold trace having a first end coupled with the first and second manifold traces and a second coupled with the third and fourth manifold traces; and a tenth manifold trace having a first end coupled with the fifth and sixth manifold traces and a second end coupled with the seventh and eighth manifold traces; and the third number of the plurality of manifold traces comprises an eleventh manifold trace having a first end coupled with the ninth manifold trace and a second end coupled with the tenth manifold trace, wherein an end of the feed line is coupled to the eleventh manifold trace.

19. The pre-matched power resistance system of claim 17, wherein the pre-matching network portion comprises:

the feed line, wherein the feed line impedance transforms the resistor to a predetermined impedance across a predetermined bandwidth; and a plurality of shunt capacitors coupled to the feed line.

20. The pre-matched power resistance system of claim 13, wherein:

the pre-matched power resistance system is one of a plurality of pre-matched power resistance systems;

a first end of a first transmission line of a Wilkinson power splitter is coupled to a first one of the plurality of pre-matched power resistance systems; and a second end of the first transmission line of the Wilkinson power splitter is coupled to a second one of the plurality of pre-matched power resistance systems.

21. The pre-matched power resistance system of claim 13, wherein the manifold comprises an equi-phase manifold network.

22. The pre-matched power resistance system of claim 13, wherein the tiered arrangement of manifold traces comprises:

a first tier of the plurality of manifold traces coupled to the plurality of sub-resistors; and a second tier of the plurality of manifold traces branching from the first tier.

23. The pre-matched power resistance system of claim 22, wherein the tiered arrangement of manifold traces further comprises a third tier of the plurality of manifold traces branching from the second tier and coupled to a feed line of the pre-matching network portion.

24. The pre-matched power resistance system of claim 13, wherein the pre-matching network portion comprises a feed line and a plurality of shunt capacitors coupled to the feed line.

25. The pre-matched power resistance system of claim 13, wherein the pre-matching network transforms a reactance of the resistor to a 50Ω resistance over a predetermined bandwidth.

* * * * *